United States Patent [19]

Hickam et al.

[11] 4,231,733

[45] Nov. 4, 1980

[54] COMBINED $O_2$/COMBUSTIBLES SOLID ELECTROLYTE GAS MONITORING DEVICE

[75] Inventors: William M. Hickam, Churchill Borough; Ching-Yu Lin, Penn Hills; John M. Zomp, North Huntingdon, all of Pa.

[73] Assignee: Westinghouse Electric Corp., Pittsburgh, Pa.

[21] Appl. No.: 911,252

[22] Filed: May 31, 1978

[51] Int. Cl.[3] ..... F23N 5/00

[52] U.S. Cl. ..... 431/76; 123/438; 204/195 S

[58] Field of Search ..... 431/76; 204/195 S, 1 T; 123/119 EC, 32 EE, 32 EA; 60/276, 285

[56] References Cited

U.S. PATENT DOCUMENTS

| | | | |
|---|---|---|---|
| 3,616,274 | 10/1971 | Eddy | 431/76 |
| 4,029,061 | 6/1977 | Asano | 60/285 |
| 4,120,270 | 10/1978 | Asano et al. | 123/32 EE |
| 4,125,356 | 11/1978 | Ohashi et al. | 431/76 |
| 4,142,482 | 3/1979 | Asano et al. | 123/119 EC |
| 4,149,502 | 4/1979 | Johnson etal. | 123/119 EC |
| 4,154,664 | 5/1979 | Renevot | 204/195 S |
| 4,156,413 | 5/1979 | Taplin | 123/119 EC |
| 4,158,166 | 6/1979 | Isenberg | 204/195 S |

*Primary Examiner*—Carroll B. Dority, Jr.
*Assistant Examiner*—Randall L. Green
*Attorney, Agent, or Firm*—M. P. Lynch

[57] ABSTRACT

A circuit means in combination with a conventional oxygen ion conductive solid electrolyte cell establishes the cell in a voltage mode for the purposes of measuring excess oxygen and developing a voltage signal indicative thereof, and switching the cell to a current mode of operation in response to an excess combustible environment wherein current drawn by the cell to pump oxygen for combustible reaction with the excess combustibles environment is measured as an indication of the combustibles content of the gas.

6 Claims, 5 Drawing Figures

COMBINED $O_2$/COMBUSTIBLES SOLID ELECTROLYTE GAS MONITORING DEVICE

BACKGROUND OF THE INVENTION

The oxygen ion conductive solid electrolyte has served as the basis of numerous oxygen measuring products. Further, the oxygen ion conductive solid electrolyte cell has served as a device for indirectly measuring the combustibles content of a gas.

In addition to the early work in this area, as evidenced by the teachings of U.S. Pat. No. Re. 28,792, which is assigned to the assignee of the present invention and incorporated herein by reference, more recent applications of the oxygen ion conductive solid electrolyte cell for both oxygen and combustibles measurements are disclosed in the following pending application and issued patent:

1. "Improved Gas Analysis Apparatus", Ser. No. 637,998, filed Dec. 5, 1975; and

2. "Improved Combustibles Analyzer", U.S. Pat. No. 4,158,166, issued June 12, 1979, both assigned to the assignee of the present invention.

While the above implementations of the basic oxygen ion conductive solid electrolyte cell provide effective means for independently measuring oxygen and combustibles, there is disclosed herein with reference to the accompanying drawings a technique whereby a single oxygen ion conductive cell is employed to measure both excess oxygen and excess combustibles content of a monitored gas environment through the use of an electronic circuit responding to a predetermined voltage threshold by switching the cell between a voltage mode and a current mode of operation.

SUMMARY OF THE INVENTION

There is disclosed herein with reference to the accompanying drawings a technique for operating a single oxygen ion conductive cell alternatively in a voltage and current mode of operation wherein the voltage mode of operation is employed under excess oxygen gas environment conditions and the current mode of operation is employed during excess combustibles gas environment conditions. The cell operates in a voltage output mode for monitoring oxygen concentrations above a preset low oxygen concentration. In this mode, the cell output voltage is limited, typically to between 0 and 125 millivolts, and measures the oxygen pressure range of between approximately 0.21 atmospheres, which is equivalent to 21% oxygen in air, and 0.001 atmospheres, equivalent to approximately 0.1% oxygen. When the oxygen concentration is lower than the preselected level, i.e., 0.01% oxygen, corresponding to a preset cell voltage, the cell voltage is electrically held at the predetermined level, i.e., 125 millivolts, and results in an oxygen current being drawn from a constant voltage power source. The oxygen current being drawn through the cell results in the transfer of oxygen from an oxygen reference source contacting one electrode of the cell through the electrolyte to an opposite electrode to combustibly react with the combustibles present in the monitored gas environment. The oxygen current is automatically controlled, based on oxygen demand requirements to combustibly react with the combustibles constitutents, to satisfy the predetermined cell voltage established by the constant voltage power source. Combustibles arriving at the electrode exposed to the monitored gas environment are monitored as an equivalent oxygen current appropriate to satisfy the oxygen requirement for combustion. Operated in this manner, the cell response provides a voltage signal for the measurement of excess oxygen and a current signal for the measurement of excess combustibles. The voltage output is a logarithmic function of the excess oxygen concentration and the current output is a linear function of the excess combustibles concentration of the monitored gas environment.

The dual operation capability exhibited by the disclosed invention makes it particularly attractive for gas monitoring and oxygen/fuel control applications associated with combustion engines, including automotive, diesels, gas turbines, etc.

DESCRIPTION OF THE DRAWINGS

The invention will become more readily apparent from the following exemplary description in connection with the accompanying drawings.

DESCRIPTION OF THE PREFERRED EMBODIMENT

Figure 1:
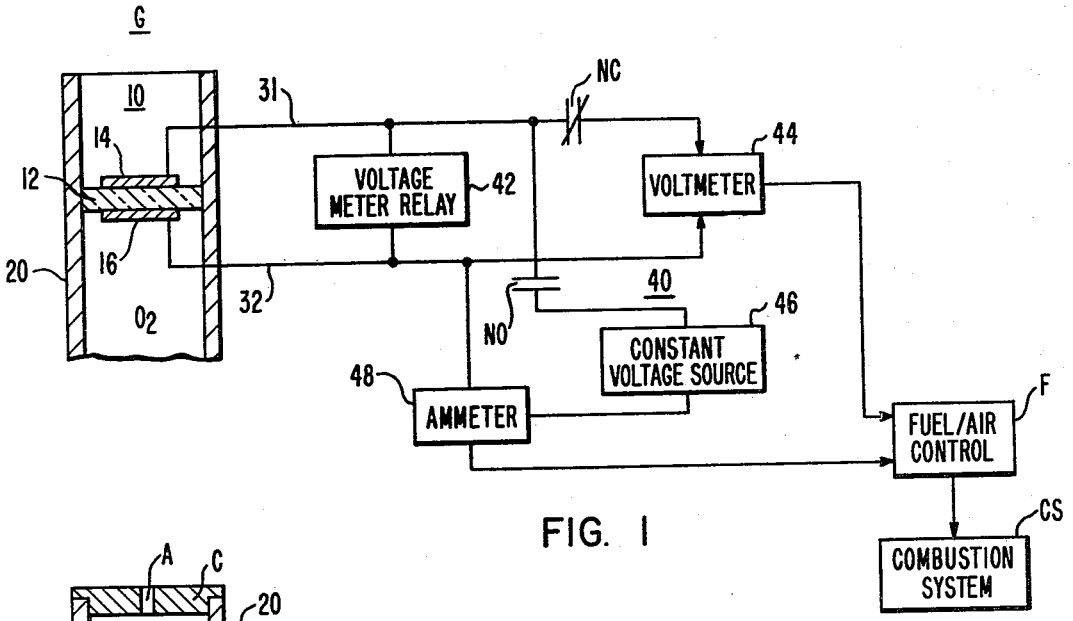
FIG. 1 is a block diagram schematic illustration of the invention.

Referring to FIG. 1, there is schematically illustrated a partial sectioned view of a gas monitoring probe device D having a solid electrolyte electrochemical cell 10 secured within a tubular probe member 20. The solid electrolyte electrochemical cell 10 consists of an oxygen ion conductive solid electrolyte member 12, a sensing electrode 14 exposed to an oxygen/combustibles monitored gas environment G, and a reference electrode 16 isolated from said monitored gas environment G and exposed to an oxygen reference environment, such as air. The electrodes 14 and 16 are typically platinum electrodes; while the solid electrolyte member 12 can be any suitable solid electrolyte oxygen ion conductive composition, such as disclosed in the above-identified Reissue patent. Electrical lead wires 31 and 32 attached to electrodes 14 and 16, respectively, electrically connect the cell 10 to electronic circuit 40.

The electronic circuit 40 includes a switching device, herein illustrated for the purpose of simplicity as a voltage meter relay 42, having an adjustable setpoint and responding to an EMF voltage from the cell 10 which equals or exceeds a predetermined level or threshold by opening normally closed relay contacts NC and closing the normally open contacts NO. Under excess oxygen conditions in the monitored gas environment G, the cell 10 operates in accordance with the Nernst equation and generates an EMF voltage corresponding to the difference in oxygen partial pressure between the sensing electrode 14 and the reference electrode 16. This difference in oxygen partial pressure across the cell 10 results in the generation of an EMF voltage signal which is supplied by normally closed contacts NC to a voltmeter 44 which is calibrated to provide a measurement of the oxygen partial pressure of the monitored gas environment G. Assuming that the oxygen partial pressure of the monitored gas environment will never exceed 0.21 atmospheres, equivalent to 21% oxygen in air, and that the reference oxygen source is air, under maximum oxygen conditions in the monitored gas environment G there will be no differential pressure across the solid electrolyte cell 12; thus, the EMF signal generated by the cell under these conditions would be 0 millivolts. The threshold of the voltage meter relay 42 is set at a millivolt level corresponding to substantially, but not quite, zero oxygen conditions in the monitored gas environment G, i.e., 0.0001 atmospheres, equivalent to 0.01% oxygen. This millivolt level for the purposes of this discussion will be considered to be about 125 millivolts. Thus, while the EMF voltage output of the cell 10 is between 0 and 125 millivolts, the voltmeter 44 will provide an indication of the oxygen partial pressure of the gas environment G.

However, at the instant that the EMF voltage of the cell 10 equals or exceeds 125 millivolts, the voltage meter relay 42 opens the normally closed contacts NC, thus disconnecting the voltmeter 44, and closes normally open contacts NO thereby connecting the series combination of a constant voltage source 46 and an ammeter 48 across the cell 10. This action transfers the operation of the electronic circuit 40 from a voltage measuring mode, for determining the oxygen content of an excess oxygen gas environment G, to a current measuring mode for monitoring the combustibles content of an excess combustibles gas environment G. The constant voltage source 46 is a constant 125 millivolt source which operates to maintain the 125 millivolt condition, corresponding to the approximately 0.01% oxygen condition at the sensing electrode 14, while allowing the cell 10 to draw current from the constant voltage source 46 to effect transfer of oxygen from the reference electrode 16 to the sensing electrode 14. The amount of current drawn, as monitored by ammeter 48, is a function of the level of oxygen required to be transferred to the sensing electrode 14 to combustibly react with the excess combustibles of the monitored gas environment G present at the sensing electrode 14. In this current mode, the measurement of current by ammeter 48 is indicative of the combustibles content of the monitored gas environment G. The selection of a constant voltage level value which assures a minimum oxygen cover of environment, i.e., 0.01% at the sensing electrode 14 protects the sensing electrode from exposure to a reducing atmosphere, such as a sulfiding environment, which can have a physical deteriorating influence on the sensing electrode 14.

Under the current mode of operation, the current measured by ammeter 48 is a measure of the oxygen demand to combust the combustibles present at the sensing electrode 14. More precisely, the current monitored by ammeter 48 is a measure of the oxygen demand to maintain the cell EMF output at the predetermined threshold level, i.e., 125 millivolts.

In the event the EMF cell voltage drops below the predetermined threshold, i.e., 125 millivolts, as monitored by the voltage meter relay 42, the normally open contacts NO and the normally closed contacts NC will revert back to their normal conditions, thereby disconnecting the constant voltage source and ammeter 48 from the cell 10 and reconnecting the voltmeter 44, and returning the electronic circuit 40 to a voltage mode of operation.

Figure 4:
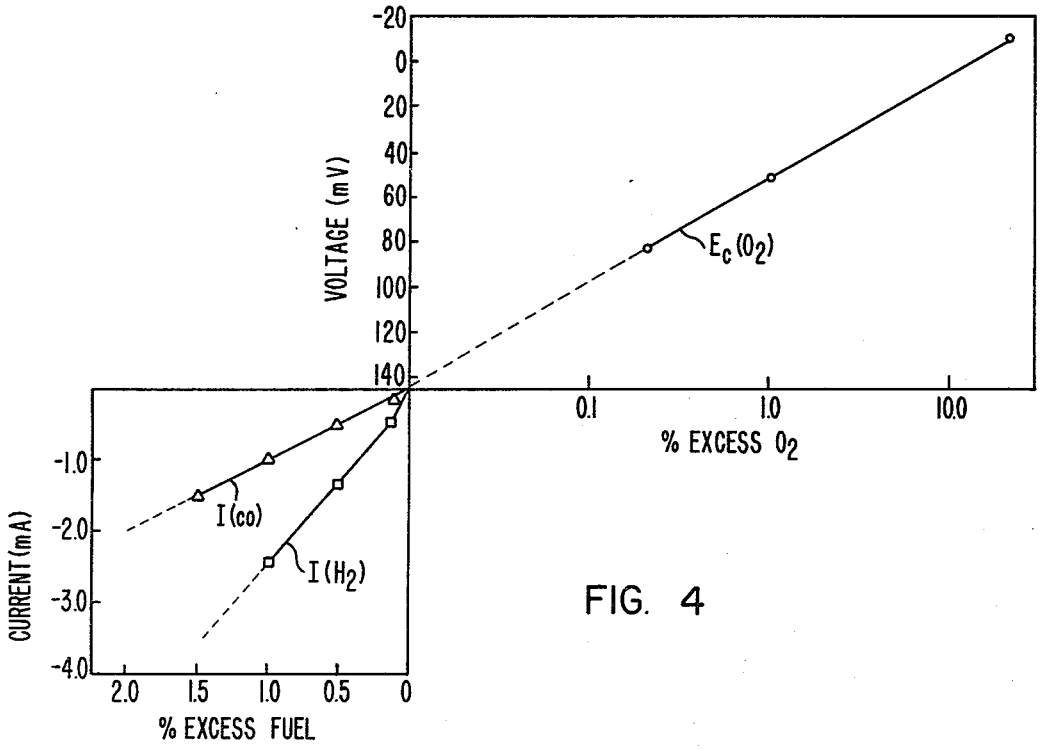
FIG. 4 is a graphical illustration of the operation of the embodiment of FIG. 1.

The combined modes of operation, voltage response for oxygen and current response for combustibles (hydrogen and carbon monoxide), are illustrated in FIG. 4. The oxygen concentration is a logarithmic function of the EMF voltage of cell 10, while the measured current in the current mode of operation is a linear function of the excess combustibles.

While the above discussion has been directed to a predetermined level corresponding to stoichiometry, the apparatus described is likewise suitable for accurately and precisely measuring the departure from stoichiometry of fuel/oxygen mixtures and providing control of fuel/oxygen supply to a combustion system at a predetermined departure from stoichiometry.

In combination with a combustion system CS of FIG. 1, such as automotive, diesel, turbine, etc., the predetermined switching level of the voltage meter relay can be set to represent the desired fuel/oxygen mix of the combustion system CS. The signals of the electronic circuit 40 are supplied to a fuel/oxygen ratio control device F which controls the fuel/oxygen ratio of the combustion system CS.

Figure 5:
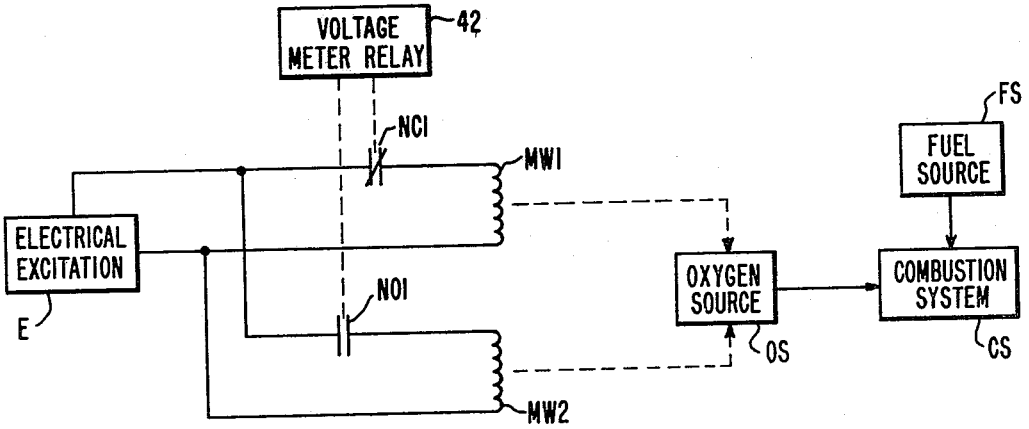
FIG. 5 is a schematic illustration of a circuit modification of FIG. 1 for controlling the oxygen supply to a combustion system.

Referring to FIG. 5, there is illustrated schematically the application of the gas monitoring apparatus of FIG. 1 for controlling the oxygen, or air, to the combustion system CS. In this configuration the oxygen monitored in the exhaust or stack of the combustion system is maintained at the 0.01% level, corresponding to the 125 millivolt setting regardless of the exchange in fuel feed from the fuel source FS to the combustion system CS.

In the event the output of the probe device D of FIG. 1 indicates an excess oxygen condition, the normally closed contacts NC1 of meter relay 42 will apply electrical excitation from source E to motor windings MW1 which control a valve or louvers in oxygen source OS to reduce oxygen supply to the combustion system CS. On output of probe device D indicative of excess combustible, the contacts NC1 of meter relay 42 open and contacts NO1 close. This results in the electrical excitation of motor winding MW2 by source E which in turn controls the oxygen source OS to increase the oxygen supply to the combustion system CS.

Figure 2:
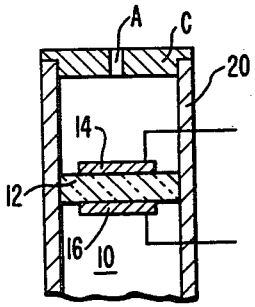
FIG. 2 is an alternate modification of the electrochemical cell of FIG. 1.

Referring to FIG. 2, there is illustrated a modification to the gas monitoring probe device 10 wherein a cap C having an aperture A therethrough is positioned at the open end of the tubular member 20 to controllably reduce the volume of the monitored gas environment G reaching the sensing electrode 14. This adapted has proven particularly useful in the current mode of operation by limiting the volume of combustibles to be combusted at the sensing electrode 14 by the oxygen transferred from the reference electrode 16. The current demand from the constant voltage source 46 for excess combustibles conditions is controlled by the diffusion rate of the combustibles through the aperture A. The concept of utilizing a diffusion limited gas apertured adapter, such as C, is disclosed in the above-identified pending applications.

Figure 3:
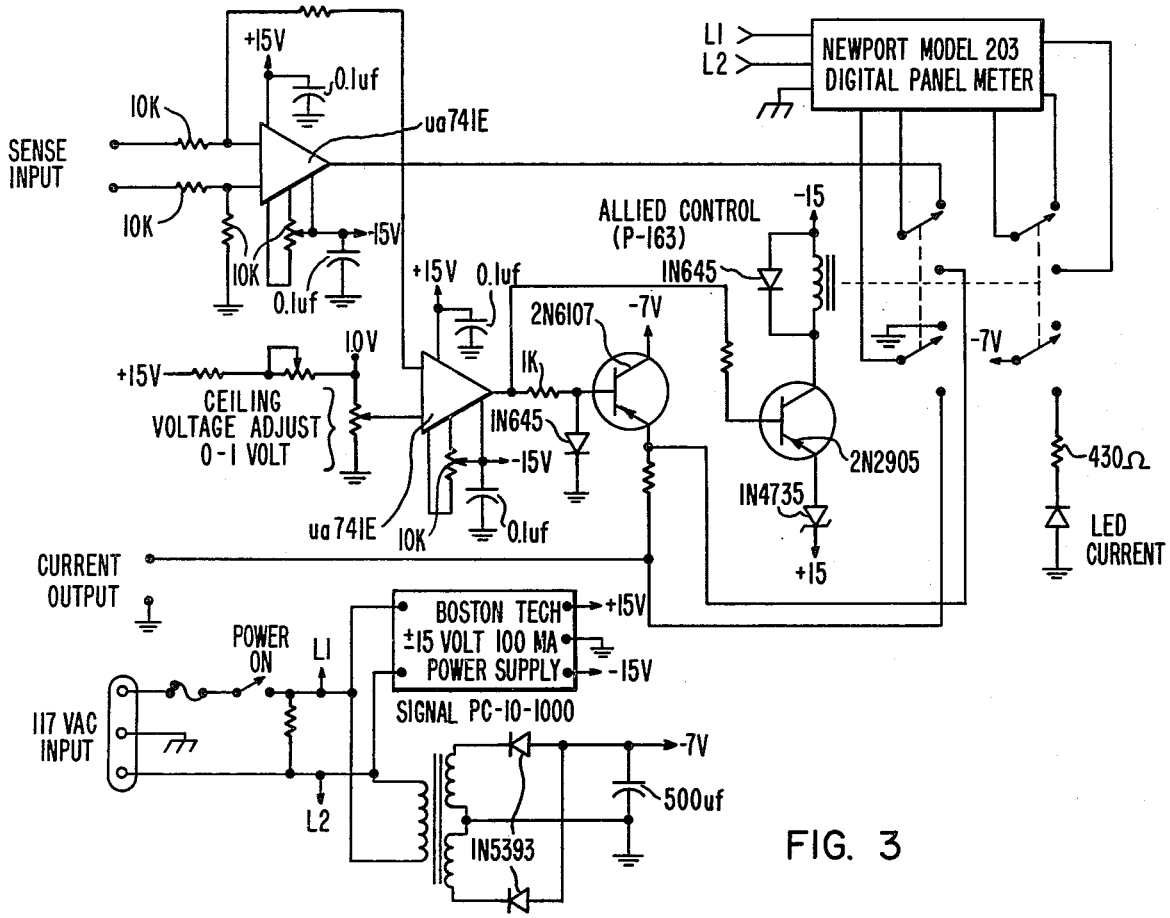
FIG. 3 is a detailed schematic illustration of a typical embodiment of the circuit of FIG. 1.

While the above-described function of the electronic circuit 40 would enable one skilled in the art to implement such a function through numerous combinations of conventional circuit elements, one such implementation employing commercially available elements is disclosed in the detailed schematic of FIG. 3.

What is claimed is:

1. An oxygen/combustibles monitoring apparatus for generating a voltage signal indicative of the oxygen content of an excess oxygen condition in a monitored gas environment and a current signal indicative of the combustibles content of an excess combustibles content in a monitored gas environment, comprising:

an oxygen ion conductive solid electrolyte cell having first and second electrodes, said first electrode being exposed to the monitored gas environment, said second electrode being isolated from said monitored gas environment and exposed to an oxygen reference environment;

an electronic circuit means connected to said first and second electrodes, said electronic circuit means including a voltage measuring circuit and a current measuring circuit, said current measuring circuit including a constant voltage source and a current measuring means, and switching means for alternatively connecting said voltage measuring circuit and said current measuring circuit to said first and second electrode in response to a predetermined difference in oxygen partial pressure at said first and second electrodes;

said predetermined difference being set such that said voltage measuring means is operatively connected to said first and second electrodes during an excess oxygen condition of the monitored gas environment, an EMF signal generated by said solid electrolyte electrochemical cell as measured by said voltage measuring means being indicative of the oxygen content of said monitored gas environment;

said predetermined difference being such that said current measuring circuit is connected to said first and second electrodes during an excess combustibles condition of the monitored gas environment, said constant voltage source of said current measuring circuit maintaining a preset voltage level across said solid electrolyte electrochemical cell, said predetermined difference corresponding to a change in said monitored gas environment from an excess oxygen condition to an excess combustibles condition, said solid electrolyte electrochemical cell drawing current from said constant voltage source to transfer oxygen from said oxygen reference environment at said second electrode to said first electrode to combustibly react with said excess combustibles at said first electrode, the level of current required to transfer oxygen being measured by said current measuring means, said current being indicative of the combustibles content of said monitored gas environment.

2. Apparatus as claimed in claim 1 wherein said switching means is a voltage responsive switching means with a variable voltage threshold setting for establishing said predetermined difference.

3. Apparatus as claimed in claim 1 wherein said preset voltage level is selected to maintain a minimum protective cover of oxygen at the surface of said first electrode under an excess combustible condition.

4. Apparatus as claimed in claim 1 further including a tubular housing, said cell being secured within said tubular housing to expose said first electrode to the monitored gas environment entering one end of said tubular housing, and means secured to said tubular housing to limit the volume per unti of time of monitored gas contacting said first electrode.

5. Apparatus as claimed in claim 1, further including an adapter means having an aperture therein operatively combined with said solid electrolyte cell to limit the monitored gas environment contacting said first electrode.

6. In a fuel/air control system for controlling the fuel/air ratio of a combustion system in response to the fuel/air content of a monitored gas environment, the combination of:

an oxygen ion conductive solid electrolyte cell having first and second electrodes, said first electrode being exposed to the monitored gas environment, said second electrode being isolated from said monitored gas environment and exposed to an oxygen reference environment;

an electronic circuit means connected to said first and second electrodes, said electronic circuit means including a voltage measuring circuit and a current measuring circuit, said current measuring circuit including a constant voltage source and a current measuring means, and switching means for alternatively connecting said voltage measuring circuit and said current measuring circuit to said first and second electrode in response to a predetermined difference in oxygen partial pressure at said first and second electrodes;

said predetermined difference being set such that said voltage measuring means is operatively connected to said first and second electrodes during an excess oxygen condition of the monitored gas environment, an EMF signal generated by said solid electrolyte electrochemical cell as measured by said voltage measuring means being indicative of the oxygen content of said monitored gas environment;

said predetermined difference being such that said current measuring circuit is connected to said first and second electrodes during an excess combustibles condition of the monitored gas environment, said constant voltage source of said current measuring circuit maintaining a preset voltage level across said solid electrolyte electrochemical cell, said predetermined difference corresponding to a change in said monitored gas environment from an excess oxygen condition to an excess combustibles condition, said solid electrolyte electrochemical cell drawing current from said constant voltage source to transfer oxygen from said oxygen reference environment at said second electrode to said first electrode to combustibly react with said excess combustibles at said first electrode, the level of current required to transfer oxygen being measured by said current measuring means, said current being indicative of the combustibles content of said monitored gas environment; and a fuel/air control means operatively connected to said electronic circuit means and responsive to output signals thereof to control the fuel/air ratio of a combustion system.

* * * * *